US011391151B2

(12) United States Patent
Ju et al.

(10) Patent No.: US 11,391,151 B2
(45) Date of Patent: Jul. 19, 2022

(54) AUTOMATIC COAL MINING MACHINE AND FLUIDIZED COAL MINING METHOD

(71) Applicants: CHINA UNIVERSITY OF MINING AND TECHNOLOGY, BEIJING, Beijing (CN); SHENZHEN UNIVERSITY, Guangdong (CN)

(72) Inventors: Yang Ju, Beijing (CN); Heping Xie, Guangdong (CN); Yong Zhang, Beijing (CN); Yan Zhu, Beijing (CN); Feng Gao, Jiangsu (CN); Xiaodong Nie, Beijing (CN); Changbing Wan, Beijing (CN); Jinxin Song, Beijing (CN); Chang Lu, Beijing (CN); Hongbin Liu, Beijing (CN); Zhangyu Ren, Beijing (CN)

(73) Assignees: CHINA UNIVERSITY OF MINING AND TECHNOLOGY, BEIJING, Beijing (CN); SHENZHEN UNIVERSITY, Guangdong (CN)

( * ) Notice: Subject to any disclaimer, the term of this patent is extended or adjusted under 35 U.S.C. 154(b) by 403 days.

(21) Appl. No.: 16/473,956

(22) PCT Filed: Mar. 23, 2018

(86) PCT No.: PCT/CN2018/080187

§ 371 (c)(1),
(2) Date: Jun. 26, 2019

(87) PCT Pub. No.: WO2019/178835

PCT Pub. Date: Sep. 26, 2019

(65) Prior Publication Data

US 2021/0340870 A1 Nov. 4, 2021

(51) Int. Cl.
*E21C 35/24* (2006.01)
*E21C 41/18* (2006.01)
(Continued)

(52) U.S. Cl.
CPC ..... *E21C 35/24* (2013.01); *E21C 41/18* (2013.01); *E21D 9/108* (2013.01); *B03B 5/18* (2013.01);
(Continued)

(58) Field of Classification Search
CPC ..... E21D 9/1073; E21D 9/116; E21D 9/001; E21D 9/002; E21D 9/10; E21D 9/087;
(Continued)

(56) References Cited

U.S. PATENT DOCUMENTS 4,032,195 A * 6/1977 Kilroy ..... E21C 25/60 299/19
4,548,443 A * 10/1985 Turner ..... E21D 9/1093 299/31
(Continued)

FOREIGN PATENT DOCUMENTS

CN 200981013 Y 11/2007
CN 101869868 A 10/2010
(Continued)

OTHER PUBLICATIONS

English language machine translation of Wang et al., CN-106089208-A, published Nov. 9, 2016 (11 pages) (Year: 2016).*
(Continued)

*Primary Examiner* — Janine M Kreck
*Assistant Examiner* — Michael A Goodwin
(74) *Attorney, Agent, or Firm* — Yue (Robert) Xu; Apex Attorneys at Law, LLP

(57) ABSTRACT

An automatic coal mining machine and a fluidized coal mining method are provided. A first excavation cabin is configured to cut coal seam to obtain raw coal and to be transported to a first coal preparation cabin for separating coal blocks from gangue. Then, the obtained coal blocks are transported to a first fluidized conversion reaction cabin. The
(Continued)

first fluidized conversion reaction cabin converts the energy form of the coal block into liquid, gas or electric energy, which is transported to a first energy storage cabin for storing. Coal mining and conversion are carried out in underground coal mines, so it is not necessary to raise coal blocks to the ground for washing and conversion, thereby reducing the transportation cost of coal, improving the utilization degree of coal, and avoiding the pollution of the ground environment caused by waste in the mining and conversion process.

9 Claims, 4 Drawing Sheets

(51) Int. Cl.

| | |
|---|---|
| ***E21D 9/10*** | (2006.01) |
| *C10G 1/00* | (2006.01) |
| *E21D 9/11* | (2006.01) |
| *E21D 9/087* | (2006.01) |
| *E21F 13/00* | (2006.01) |
| *B03B 5/18* | (2006.01) |
| *C10J 3/50* | (2006.01) |
| *E21C 25/16* | (2006.01) |
| *E21C 35/20* | (2006.01) |

(52) U.S. Cl.
CPC ..... *C10G 1/00* (2013.01); *C10J 3/506* (2013.01); *C10J 2300/093* (2013.01); *C10J 2300/1625* (2013.01); *C10J 2300/1643* (2013.01); *C10J 2300/1671* (2013.01); *E21C 25/16* (2013.01); *E21C 35/20* (2013.01); *E21D 9/087* (2013.01); *E21D 9/116* (2013.01); *E21F 13/002* (2013.01)

(58) Field of Classification Search
CPC ..... E21D 9/108; E21C 37/16; E21C 37/18; E21C 41/24; E21C 41/18; E21C 25/16; E21C 35/20; E21C 35/24; E21F 13/002; E21F 13/02; E21F 13/04; E21F 13/042; E21F 13/06; E21F 13/063; E21B 7/14; E21B 7/15; E21B 43/28; E21B 43/281; E21B 43/285; E21B 43/29; E21B 43/292; B03B 5/18; C10G 1/00; C10J 3/506; C10J 2300/093; C10J 2300/1625; C10J 2300/1643; C10J 2300/1671
See application file for complete search history.

(56) References Cited

U.S. PATENT DOCUMENTS

| | | | | |
|---|---|---|---|---|
| 5,813,482 | A * | 9/1998 | Barbera | E21B 7/046 175/171 |
| 2003/0038526 | A1* | 2/2003 | Drake | E21D 9/12 299/18 |
| 2010/0148566 | A1* | 6/2010 | Home | E21D 9/001 299/31 |
| 2014/0079485 | A1* | 3/2014 | Li | E21D 9/003 405/141 |
| 2014/0219725 | A1* | 8/2014 | Harrison | E21D 9/02 405/138 |

FOREIGN PATENT DOCUMENTS

| | | | |
|---|---|---|---|
| CN | 102392637 | A | 3/2012 |
| CN | 202578697 | U | 12/2012 |
| CN | 204746555 | U | 11/2015 |
| CN | 106089208 | A | 11/2016 |
| RU | 2514248 | C1 | 4/2014 |

OTHER PUBLICATIONS

International Search Report for PCT/CN2018/080187 dated Sep. 28, 2018, ISA/CN.

Xie, Heping et al., "Theoretical and technological conception of the fluidization mining for deep coal resources", Journal of China Coal Society, vol. 42, No. 3, Mar. 2017, p. 547-556 [Not prior art, see declaration].

Xie, Heping et al., "Groundbreaking theoretical and technical conceptualization of fluidized", Tunnelling and Underground Space Technology, Apr. 30, 2017,p. 68-70 [Not prior art, see declaration].

The Canadian 2nd Office Action dated Mar. 15, 2021 for CA3050034.

* cited by examiner

AUTOMATIC COAL MINING MACHINE AND FLUIDIZED COAL MINING METHOD

CROSS-REFERENCE

This application is a National Phase entry of PCT Application No. PCT/CN2018/080187, filed on Mar. 23, 2018, the entire disclosure of which is incorporated herein by reference.

FIELD

The present application relates to the technical field of coal mining, and in particular to an automatic coal mining machine and a fluidized coal mining method.

STATEMENT REGARDING PRIOR DISCLOSURES BY THE INVENTOR OR A JOINT INVENTOR

An essay "Theoretical and technological conception of the fluidization mining for deep coal resources" is disclosed in JOURNAL OF CHINA COAL SOCIETY, 2017, 42(3): 547-556, published on Mar. 31, 2017, by J U, Yang, XIE, Heping, GAO, Feng, et al.

Another essay "Groundbreaking theoretical and technical conceptualization of fluidized mining of deep underground solid mineral resources" is disclosed in Tunnelling and Underground Space Technology 67(2017)68-70, published on May 7, 2017, by J U, Yang, XIE, Heping, GAO, Feng, et al.

BACKGROUND

A traditional coal mining method is to transport the underground mined coal resources to the ground, and then perform the washing, conversion and utilization on the ground (for example, using coal to generate electric energy). The entire process is very complicated, moreover, the cost of transporting coal and lifting the mined coal from the mine to the ground is also very high. In addition, the process of washing and conversion and utilization on the ground causes a large number of pollution sources such as solid waste pollution, air pollution. Therefore, there is an urgent need for an unmanned automatic coal mining machine and a mining method which can directly and automatically complete a series of processes such as coal mining, washing, coal conversion.

SUMMARY

In view of this, a purpose of the present invention is to provide an automatic coal mining machine and a fluidized coal mining method, which is capable of directly completing a series of processes such as coal mining, washing, coal conversion in an underground coal mine.

In one aspect, an automatic coal mining machine is provided according to the application, including a first excavation cabin, a first coal preparation cabin, a first fluidized conversion reaction cabin, and a first energy storage cabin;

a cutter dish for cutting coal mass is provided at a head of the first excavation cabin, and raw coal cut by the cutter dish is transported to the first coal preparation cabin;

the first coal preparation cabin is connected to the first excavation cabin by a detachable flexible component, so as to separate coal blocks from gangues in the raw coal and to transport the coal blocks to the first fluidized conversion reaction cabin;

the first fluidized conversion reaction cabin is connected to the first coal preparation cabin by a detachable flexible component, so as to convert the energy form of coal blocks into liquid, gas or electric energy and to transport the liquid, gas or electric energy to the first energy storage cabin;

the first energy storage cabin is connected to the first fluidized conversion reaction cabin by a detachable flexible component, so as to store the energy converted from the coal blocks.

Optionally, the first excavation cabin includes: the cutter dish, an pushing mechanism and a first conveyor belt;

the cutter dish is fixed at the head of the first excavation cabin;

the pushing mechanism is arranged behind the cutter dish and fixed on a bottom plate of the first excavation cabin;

the first conveyor belt is arranged on the bottom plate of the first excavation cabin.

Optionally, the first excavation cabin further includes: a first supporting seat and a supporting mechanism;

the first supporting seat is fixed on the bottom plate of the first excavation cabin, and a space between the first supporting seat and the bottom plate enables the first conveyor belt and the objects transported on the first conveyor belt to pass through;

the supporting mechanism is fixed on the first supporting seat for reinforcing an excavated roadway.

Optionally, the first coal preparation cabin includes: a crusher, a movable screen jig, a second conveyor belt and a discharge pipeline;

the crusher is fixed on a bottom plate of the first coal preparation cabin, so as to crush the raw coal cut by the first excavation cabin;

the second conveyor belt is fixed on the bottom plate of the first coal preparation cabin and is located behind the crusher;

the movable screen jig is arranged on the bottom plate of the first coal preparation cabin and is located behind the second conveyor belt, so as to sort the raw coal transported by the second conveyor belt and to transport the sorted coal blocks to the first fluidized conversion reaction cabin;

the discharge pipeline is arranged at a side of the movable screen jig, so as to discharge the sorted gangues from the first coal preparation cabin.

Optionally, the first fluidized conversion reaction cabin includes: a fluidized conversion system;

the fluidized conversion system is arranged on a bottom plate of the first fluidized conversion reaction cabin for converting the coal blocks into liquid, gas or electric energy.

Optionally, the first energy storage cabin includes a fluidized product storage device and an energy storage device;

the fluidized product storage device is fixed on a bottom plate of the first energy storage cabin for storing the converted fluidized energy products;

the energy storage device is fixed on the bottom plate of the first energy storage cabin for storing the converted electric energy.

Optionally, the automatic coal mining machine further includes: a supporting cabin;

the supporting cabin is connected to the first excavation cabin by a detachable flexible component, so as to support and protect the excavated roadway when a mine is constructed and a roadway is excavated.

Optionally, the supporting cabin includes: a second supporting seat, a gas extraction mechanism, a grouting reinforcement mechanism and a roadway lining mechanism;

the second supporting seat is fixed on a bottom plate of the supporting cabin, and a space between the second supporting seat and the bottom plate enables the first conveyor belt and the objects transported on the first conveyor belt to pass through;

the gas extraction mechanism is fixed on the second supporting seat, so as to extract the gas in coal seams on both sides of an excavated roadway;

the grouting reinforcement mechanism is fixed on the second supporting seat, so as to inject chemical slurry into the coal seams on both sides of the roadway for reinforcing coal walls on both sides of the roadway;

the roadway lining mechanism is fixed on the second supporting seat for lining the roadway.

Optionally, the automatic coal mining machine further includes: a second excavation cabin, a second coal preparation cabin, a second fluidized conversion reaction cabin and a second energy storage cabin;

the second energy storage cabin is connected to the first energy storage cabin by a detachable flexible component;

the second fluidized conversion reaction cabin is connected to the second energy storage cabin by a detachable flexible component;

the second coal preparation cabin is connected to the second fluidized conversion reaction cabin by a detachable flexible component;

the second excavation cabin is connected to the second coal preparation cabin by a detachable flexible component.

Optionally, the coal mining machine further includes a remote console. The remote console is configured to control a working state of the first excavation cabin, the first coal preparation cabin, the first fluidized conversion reaction cabin and the first energy storage cabin according to the operation state of the automatic coal mining machine.

In another aspect, a fluidized coal mining method is further provided according to the application, which is applied to the automatic coal mining machine in any one of the solutions in the first aspect. The automatic coal mining machine includes a first excavation cabin, a first coal preparation cabin, a first fluidized conversion reaction cabin and a first energy storage cabin; the method includes:

controlling the first excavation cabin to cut coal mass in front of the automatic coal mining machine;

controlling the first coal preparation cabin to separate coal blocks from gangues in raw coal excavated by the first excavation cabin;

controlling the first fluidized conversion reaction cabin to convert the coal blocks separated in the first coal preparation cabin into liquid, gas or electric energy, and to store the converted liquid, gas or electric energy in the first energy storage cabin.

The automatic coal mining machine provided by the present embodiment includes the first excavation cabin, the first coal preparation cabin, the first fluidized conversion reaction cabin and the first energy storage cabin, and each cabin is connected by a corresponding detachable flexible component; the first excavation cabin is configured to cut coal seams into raw coal and to transport the raw coal to the first coal preparation cabin for separating coal blocks from gangues. Then, the separated coal blocks are transported to the first fluidized conversion reaction cabin. The first fluidized conversion reaction cabin is configured to convert the energy form of the coal blocks into liquid, gas or electric energy, and to transport the liquid, gas or electric energy to the first energy storage cabin for storing. Coal mining and conversion are carried out in underground coal mines, so it is not necessary to raise coal blocks to the ground for washing and converting, thereby reducing the transportation cost of coal, improving the utilization degree of coal, and avoiding the pollution of the ground environment caused by the waste generated in an excavating and converting process. In addition, the entire system can control each cabin of the coal mining machine through a remote console on the ground to complete a corresponding operation, and no one needs to go underground to operate the automatic coal mining machine.

BRIEF DESCRIPTION OF THE DRAWINGS

In order to more clearly illustrate the embodiment of the present application or the technical proposal in the conventional art, the accompanying drawings used in the embodiment or the description of the conventional art are briefly introduced hereinafter. Obviously, the accompanying drawings described hereinafter are only several embodiments of the present application, and for those skilled in the art, other accompanying drawings may also be obtained according to these accompanying drawings without any creative work.

DETAILED DESCRIPTION OF EMBODIMENTS

A traditional coal mining method is to raise the underground mined coal to the ground, and to perform the washing and conversion and utilization. The transportation cost is high, and the waste generated by conversion and utilization process causes pollution to the environment. In addition, with the coal occurrence and mining depth getting deeper and deeper, the traditional mining and rock mechanics theory is no longer applicable. When the exploitation of coal resources reaches a certain depth, for example, below 2000 m, the temperature in a coal mine has exceeded a range that a human body can bear. Therefore, human beings cannot enter the coal mine for mining operations. The automatic coal mining machine and fluidized coal mining method provided in the present application can convert coal in underground coal mines without raising coal blocks to the ground for washing, conversion and utilization, thus reducing transportation costs, and avoiding the pollution of waste generated in the conversion and utilization process to the ground. Moreover, the entire process of mining and conversion is controlled by a remote console to complete the corresponding operation of each cabin, and no one needs to go underground to perform an operation.

In order to more clearly illustrate purposes, technical proposals and advantages in the embodiments of the present application, the technical proposals in the embodiments of the present application are clearly and completely described hereinafter with reference to the accompanying drawings in the embodiments of the present application. Obviously, the embodiments described hereinafter are only part of the embodiments of the present application, not all of the embodiments, all other embodiments obtained according to the embodiments of the present application by ordinary skilled in the art without any creative work fall within the scope of protection of the present application.

Figure 1:
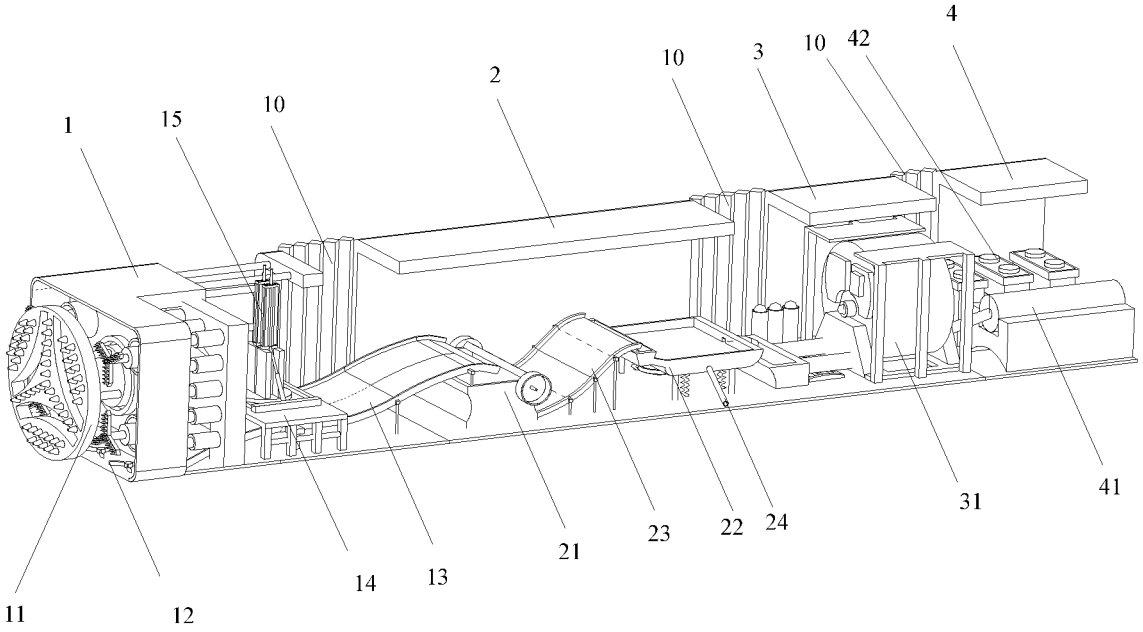
FIG. 1 is a schematic structure view of an automatic coal mining machine according to an embodiment of the present application.

Referring to FIG. 1, FIG. 1 shows a schematic structure view of an automatic coal mining machine according to an embodiment of the present application. The automatic coal mining machine also is known as an Unmanned Mining Machine (UMM).

As shown in FIG. 1, the automatic coal mining machine includes: a first excavation cabin 1, a first coal preparation cabin 2, a first fluidized conversion reaction cabin 3, and a first energy storage cabin 4.

Each cabin is connected each other by a detachable flexible component 10, which facilitates an overall turning of the automatic coal mining machine. The detachable flexible component 10 is strong enough to firmly connect to each cabin, and is soft enough to have a certain turning angle between each cabin when the coal mining machine is turning.

Moreover, each cabin has a power drive device, which can move forward and backward independently, turn, and achieve climbing a small inclination upslope and a downhill.

Preferably, when the automatic coal mining machine is working, a remote console installed on the ground can control a working state of each cabin according to an operation state of each cabin, and a wireless communication can be carried out between the remote console and each cabin.

A state collection device (for example, various sensors) is installed in each cabin of the automatic coal mining machine, the state parameters collected by the state collection device are uploaded to the remote console, which control the working state of each cabin according to these state parameters.

The first excavation cabin 1 is configured to excavate a roadway and mine a coal seam, and to transport the excavated raw coal to the first coal preparation cabin 2.

In an embodiment of the present application, the first excavation cabin 1 includes a cutter dish 11, a pushing mechanism 12 and a conveyor belt 13.

The cutter dish 11 is provided at a head of the first excavation cabin 1, and the cutter dish 11 is configured to rotate and cut the coal seam in front.

The pushing mechanism 12 is arranged behind the cutter dish 11 and is fixed on a bottom plate of the first excavation cabin 1. The pushing mechanism 12 is configured to transport the coal materials cut by the cutter dish 11 to the conveyor belt 13.

In an embodiment of the present application, the pushing mechanism 12 may be a star wheel, which can be fixed to a bottom plate of the first excavation cabin 1 by a bolt.

The raw coal cut by the cutter dish 11 falls in front of the star wheel. With the excavation cabin moving forward, the raw coal is transported to the conveyor belt 13 behind the star wheel by the rotation of the star wheel.

The number of star wheel is determined by a size of the star wheel and a width of a bottom plate of the first excavation cabin 1.

The conveyor belt 13 is fixed on a bottom plate behind the pushing mechanism 12 in the first excavation cabin 1. The conveyor belt 13 extends to the first coal preparation cabin 2 connected to a tail of the first excavation cabin 1 for transporting the raw coal to the first coal preparation cabin 2.

Optionally, as shown in FIG. 1, the first excavation cabin 1 further includes a first supporting seat 14 and a supporting mechanism 15.

The first supporting seat 14 is fixed on a bottom plate at the tail of the first excavation cabin 1, and a space between the first supporting seat 14 and the bottom plate enables the conveyor belt 13 and the objects transported on the conveyor belt to pass through smoothly.

In an embodiment of the present application, the first supporting seat can be welded on the bottom plate of the excavation cabin, which is more firm.

The supporting mechanism 15 is fixed on the first supporting seat 14, so as to reinforce the excavated roadway.

For example, the supporting mechanism 15 can use a roof bolt driller for supporting and protecting the excavated roadway, which prevents the roof of the roadway from collapsing and the coal wall from collapsing. The roof bolt driller can be fixed on the first supporting seat 14 by a bolt.

The first coal preparation cabin 2 is detachably connected to the first excavation cabin 1. The first coal preparation cabin 2 is configured to separate coal blocks from gangues in raw coal and to transport the separated coal blocks to the first fluidized conversion reaction cabin 3.

In an embodiment of the present application, as shown in FIG. 1, the first coal preparation cabin 2 may include a crusher 21, a movable screen jig 22, a conveyor belt 23 and a discharge pipeline 24.

The crusher 21 is fixed on a bottom plate of the coal preparation cabin, and configured to crush the raw coal transported from the excavation cabin 1.

The conveyor belt 23 is fixed on the bottom plate of the first coal preparation cabin 2 and is located behind the crusher 21. The movable screen jig 22 is fixed on the bottom plate of the first coal preparation cabin 2 and is located behind the conveyor belt 23. The discharge pipeline 24 is arranged on a side of the movable screen jig 22.

The conveyor belt 23 is configured to transport small coal and gangue blocks crushed by the crusher 21 to the movable screen jig 22 behind. The movable screen jig 22 is configured to separate the small coal and small gangue blocks which conveyed by the conveyor belt 23, and discharge the separated gangues in the first coal preparation cabin 2 through the discharge pipeline 24. At the same time, the small coal blocks are transported to the first fluidized conversion reaction cabin 3.

The first fluidized conversion reaction cabin 3 can be detachably connected to the first coal preparation cabin 2. The first fluidized conversion reaction cabin 3 is configured to convert the energy form of coal blocks into liquid, gas or electric energy, and to transport the liquid, gas or electric energy to the first energy storage cabin 4.

The first fluidized conversion reaction cabin 3 includes a fluidized conversion system 31 arranged on a bottom plate of the fluidized conversion reaction cabin, by using the technologies such as coal liquefaction, gasification, the fluidized conversion system 31 converts the solid coal into the fluidized energy such as liquid or gas, or by using the electrochemical technology, the fluidized conversion system 31 converts the solid coal into electric energy.

The first energy storage cabin 4 is detachably connected to the first fluidized conversion reaction cabin 3, so as to store the energy converted from the first fluidized conversion reaction cabin 3.

In an embodiment of the present application, the first energy storage cabin 4 includes a fluidized product storage device 41 and an energy storage device 42.

The fluidized product storage device 41 and the energy storage device 42 are fixed on a bottom plate of the first energy storage cabin 4.

The fluidized product storage device 41 is configured to store the liquid and gas converted in the first fluidized conversion reaction cabin 3. The energy storage device 42 is configured to store the electric energy converted in the fluidized conversion reaction cabin 3.

Multiple fluidized product storage devices 41 and multiple energy storage device 42 may be arranged and the number can be adjusted according to the energy storage situation.

The automatic coal mining machine provided by the present embodiment, the excavation cabin is configured to cut a coal seam to obtain raw coal and to transport the raw coal to the coal preparation cabin for separating coal blocks from gangues therein. Then, the obtained coal blocks are transported to the fluidized conversion reaction cabin. The fluidized conversion reaction cabin converts the energy form of the coal block into liquid, gas or electric energy, which is transported to the energy storage cabin for storing. The coal mining and conversion are carried out in the underground coal mine, it is not necessary to raise the coal block to the ground for washing and converting, thereby reducing the transportation cost of coal, and avoiding the pollution of the waste generated in the conversion process to the ground. In addition, the entire process is controlled by the remote console on the ground to complete the corresponding operation of each cabin, and no one needs to go underground to operate the automatic coal mining machine.

In another embodiment of the present application, an excavation cabin and a supporting cabin are required in the stage of constructing a mine and excavating a roadway. The functions and composition of the excavation cabin are not described in the present embodiment.

Figure 2:
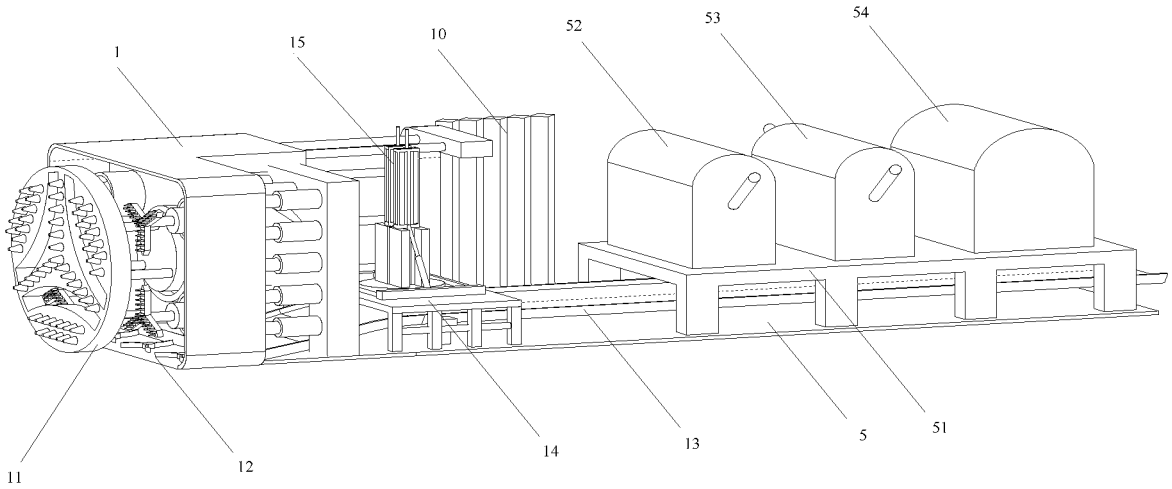
FIG. 2 is a schematic structure view of another automatic coal mining machine according to the embodiment of the present application.

As shown in FIG. 2, the automatic coal mining machine includes a first excavation cabin 1 and a supporting cabin 5 connected by a detachably flexible component 10.

The supporting cabin 5 is configured to support and protect the excavated roadway in the stage of constructing a mine and excavating a roadway.

As shown in FIG. 2, the supporting cabin 5 includes a second supporting seat 51, a gas extraction mechanism 52, a grouting reinforcement mechanism 53 and a roadway lining mechanism 54.

The second supporting seat 51 is fixed on a bottom plate of the supporting cabin 5, and a space between the second supporting seat 51 and the bottom plate enables a conveyor belt extending from the first excavation cabin 1 and the objects transported on the conveyor belt to pass through smoothly.

The gas extraction mechanism 52 is fixed on the second supporting seat 51 for extracting gas in coal seams on both sides of the excavated roadway.

The grouting reinforcement mechanism 53 is fixed on the second supporting seat 51, so as to inject specific chemical slurry into the coal seams on both sides of the roadway to reinforce the coal walls on both sides of the roadway.

The roadway lining mechanism 54 is fixed on the second supporting seat 51, so as to provide an all-round and high-strength lining support for the excavated roadway to increase a service life of the roadway.

After completing the mine construction, the first excavation cabin 1 and the supporting cabin 5 of the automatic coal mining machine are dismantled, and the supporting cabin 5 is lifted to the ground. The first coal preparation cabin 2, the first fluidized conversion reaction cabin 3 and the first energy storage cabin 4 and the detachably flexible components 10 connecting with each cabin are transported to the underground mine for assembly and connection.

The working process of the automatic coal mining machine in two stages is illustrated in detail hereinafter:

A first stage: constructing a mine and excavating a roadway

The first excavation cabin 1, the supporting cabin 5 and the detachably flexible components 10 are transported to underground for connection and assembly, and the roadway is excavated after the assembly is completed. The cutter dish 11 on the first excavation cabin 1 cuts coal in front of the excavation cabin, and the cut raw coal is transported to the conveyor belt 13 by the pushing mechanism 12, and is transported to a tail of the supporting cabin 5 by the conveyor belt 13 and is discharged out of the cabin. Then, the cut raw coal is transported out of the roadway by an intelligent shuttle car in the mine.

In the case of excavating the roadway, the supporting mechanism 15 in the first excavation cabin 1 provides a roof bolt around the roadway. At the same time, the gas extraction mechanism 52 in supporting cabin 5 extracts gas from both sides of the roadway; the chemical grouting mechanism 53 injects specific chemical slurry into both sides of the roadway to reinforce a coal wall; and the roadway lining mechanism 54 provides an all-round and high-strength lining support for the excavated roadway to increase a service life of the roadway.

The lining supporting is an engineering measure to ensure the stability of surrounding rock in underground cabin, that is, to build a wall of a certain thickness with strip stone, concrete or reinforced concrete in underground cabin to passively bear the load.

At the same time, energy transmission pipelines are laid in the excavated roadway to transport the extracted gas to a designated location.

A second stage: coal seam mining

After the mine construction is completed, it enters the stage of coal seam mining. The first excavation cabin 1 and the supporting cabin 5 are separated and the supporting cabin 5 is lifted to the ground. Then, the first coal preparation cabin 2, the first fluidized conversion reaction cabin 3, the first energy storage cabin 4 and detachable flexible components 10 are transported to the underground mine for assembly and connection.

A similar "strip" route is adopted to do a bidirectional coal mining during the coal seam mining. A main structure of the automatic coal mining machine includes front and back parts, and the front and back parts are of mirror distribution.

Figure 4:
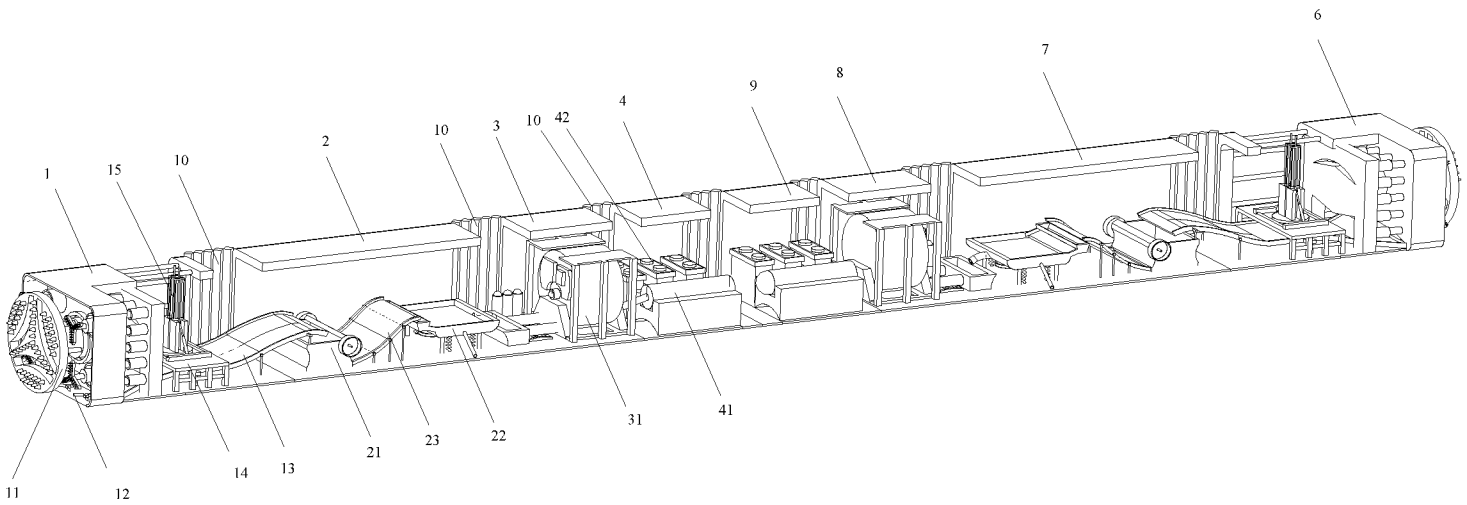
FIG. 4 is a schematic structure view of another automatic coal mining machine according to the embodiment of the present application.

As shown in FIG. 4, a first half of the automatic coal mining machine from left to right includes the first excavation cabin 1, the first coal preparation cabin 2, the first fluidized conversion reaction cabin 3 and the first energy storage cabin 4, and the second half from right to left includes the second excavation cabin 6, the second coal preparation cabin 7, the second fluidized conversion reaction cabin 8 and the second energy storage cabin 9.

The structures and functions of the first excavation cabin 1 and the second excavation cabin 6, the first coal preparation cabin 2 and the second coal preparation cabin 7, the first fluidized conversion reaction cabin 3 and the second fluidized conversion reaction cabin 8, the first energy storage cabin 4 and the second energy storage cabin 9, are identical respectively. In order to distinguish the two parts, the first and the second are used for distinguishing them. In addition, detachable flexible components 10 are used for connecting with each cabin.

In the stage of coal seam mining, the function of the excavation cabin is basically same as that during constructing a mine and excavating a roadway. The difference is that supporting mechanisms 15 in the excavation cabin provides a roof bolt around the roadway during excavating the roadway, while supporting mechanisms 15 in the excavation cabin support bolts only on a roof of the roadway during coal seam mining.

In the bidirectional coal mining with the "strip" route, a front half of the automatic coal mining machine is used for working in an advancing coal mining. After arriving the mine boundary, the automatic coal mining machine stops to turn to a retrograde coal mining, while a latter part of the automated coal mining machine is used for working in the retrograde coal mining. After arriving the other side of the mine boundary, the automatic coal mining machine stops to turn to the advancing coal mining.

In the advancing coal mining, the first excavation cabin 1 is configured to excavate the coal, the first coal preparation cabin 2 is configured to sort raw coal, and the first fluidized conversion reaction cabin 3 is configured to convert the coal energy form, and the first energy storage cabin 4 is configured to store the converted energy. In the retrograde coal mining, the second excavation cabin 6 is configured to excavate the coal, the second coal preparation cabin 7 is configured to sort the raw coal, the second fluidized conversion reaction cabin 8 is configured to convert the coal energy form, and the second energy storage cabin 9 is configured to store the converted energy.

Since an overall length of the automatic coal mining machine is long and the turning radius is large, it is necessary to design a specific way of changing lanes when the advancing coal mining and the retrograde coal mining are converted to each other.

Figure 3:
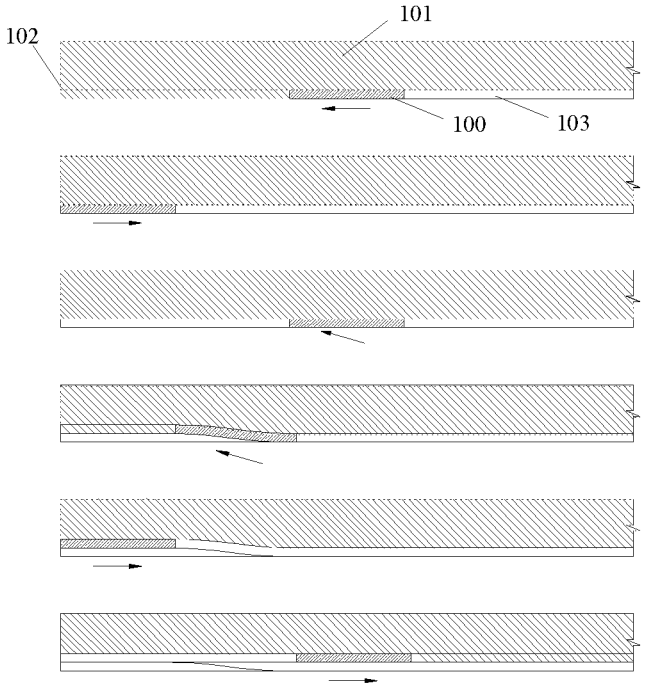
FIG. 3 is a top view of decomposition steps of a bidirectional coal changing lane mode of the automatic coal mining machine according to the embodiment of the present application.

As shown in FIG. 3, the automatic coal mining machine 100 moves forward along a straight line and mines the excavated coal 101, and retrogrades a certain distance along the original path after mining to the mine field boundary 102. Then, the automatic coal mining machine changes a lane and moves forward. When the automatic coal mining machine moves forward and mines to the mine field boundary 102, it just completes changing the lane; after the lane is changed, the automatic coal mining machine retrogrades along the straight line again and mines to the other side of the mine field boundary, and converts into the advancing coal mining according to the same way of changing lanes.

Optionally, a variety of energy transmission pipelines are arranged in the roadway perpendicular to the "strip" route. After the energy transmission pipelines are docked with the automatic coal mining machine, the in-situ converted fluidized energy and/or electric energy can be transported to a designated location. At the same time, the energy transmission pipeline can further supply the energy and water needed in a normal operation of the automatic coal mining machine.

In order to prevent an overburden strata from caving in a goaf 103 and effecting the mining operation of the automatic coal mining machine after the automatic coal mining machine 100 works, supporting mechanisms laid in the first excavation cabin and the second excavation cabins are configured to support a roof bolt on the roof while the coal is mined, and the goaf 103 is filled in time.

The filling slurry is transported from the ground to the underground through filling drilling holes from the ground to the underground mine, and then the slurry is transported to the goaf 103 through filling pipelines laid in the roadway, and is mixed with the gangue sorted by the movable screen jig 22, to complete filling the goaf 103.

On the other hand, a fluidized coal mining method using the automatic coal mining machine provided in the above embodiment is further provided according to the present application.

Figure 5:
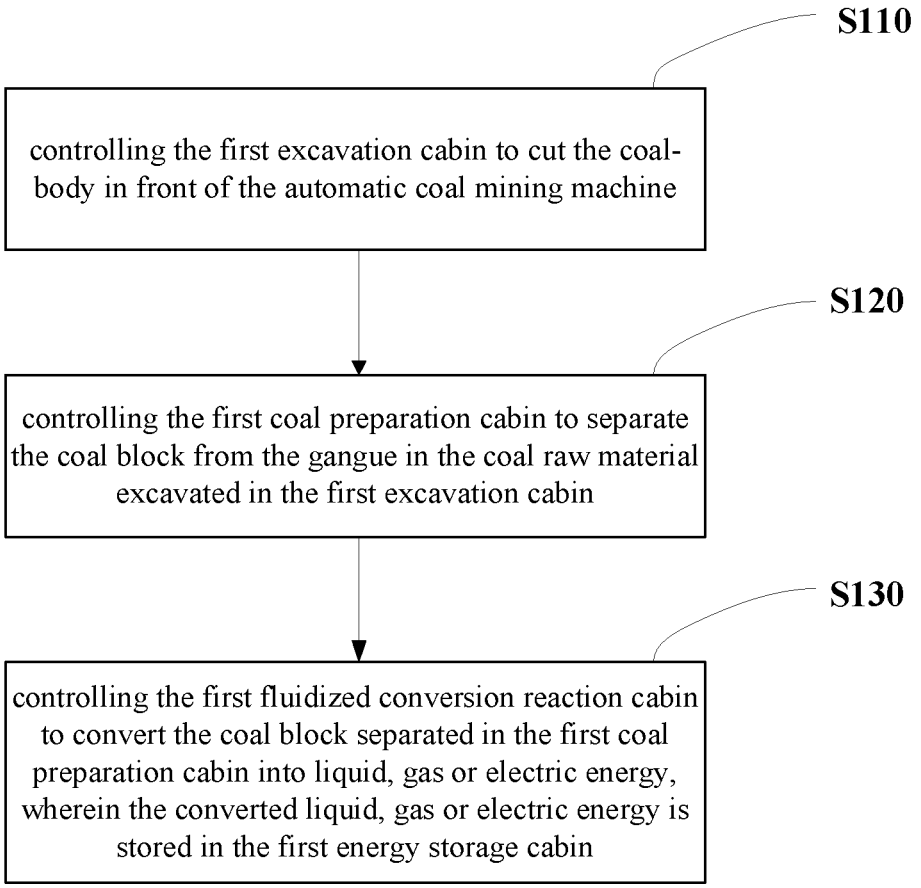
FIG. 5 is a flowchart of fluidized coal mining using an automatic coal mining machine according to the embodiment of the present application.

Referring to FIG. 5, it shows a flow chart of a fluidized coal mining method according to the present application, which is applied to a remote console of the above-mentioned automatic coal mining machine. As shown in FIG. 5, the method may include the following steps:

S110, controlling the first excavation cabin to cut the coal in front of the automatic coal mining machine;

S120, controlling the first coal preparation cabin to separate the coal block and gangue from the raw coal excavated in the first excavation cabin;

S130, controlling the first fluidized conversion reaction cabin to convert the coal blocks sorted from the first coal preparation cabin into liquid, gas or electric energy, and to store the transformed liquid, gas or electric energy in the first energy storage cabin.

The fluidized coal mining method provided in the present embodiment can realize the coal mining and conversion under the mine without lifting the coal block to the ground for washing and conversion, thereby reducing the transportation cost of coal and avoiding the pollution of the waste generated in the conversion process to the ground. Moreover, the entire process is controlled by a remote console on the ground to complete the corresponding operation of each cabin, and no one needs to go underground to operate the automatic coal mining machine.

The remote console in the present embodiment may be a terminal or a host computer.

For the purposes of simple description, the foregoing method embodiments are described as a series of action combinations, but those skilled in the art should be aware that the present invention is not limited by the described action sequence, because according to the present invention, certain steps may be performed in other order or simultaneously. Secondly, those skilled in the art should also be aware that the embodiments described in the specification are preferred embodiments and that the actions and modules involved are not necessary for the invention.

It should be noted that the various embodiments in this specification are described in a progressive manner. Each embodiment focuses on the differences from other embodiments, and the same and similar parts among the embodiments can be referred to each other. For device-like embodiments, since they are basically similar to the method embodiments, the description is relatively simple, and the relevant points can be referred to part of the description of the method embodiments.

Finally, it should be noted that in this article, relational terms such as first and second are used only to distinguish one entity or operation from another entity or operation, without necessarily requiring or implying any such actual relationship or order between these entities or operations. Moreover, the term "include", "comprise" or any other variation thereof is intended to cover non-exclusive inclusions, so that a process, a method, an object or a device including a series of elements includes not only those elements, but also other elements that are not explicitly listed, or the elements inherent in the process, the method, the object or the device. In the absence of further restrictions, elements limited by the statement "includes one . . . "

do not exclude the existence of other identical elements in processes, methods, articles or equipment that include the said elements.

The above description of the disclosed embodiments enables those skilled in the art to implement or use the present invention. Various modifications to these embodiments are apparent to those skilled in the art, and the general principles defined herein may be implemented in other embodiments without departing from the spirit or scope of the present invention. Therefore, the present invention will not be limited to the embodiments shown herein, but will conform to the widest range consistent with the principles and novel features disclosed herein.

The above is only a preferred embodiment of the present invention, it should be pointed out that for ordinary technicians in the technical field, without departing from the principles of the present invention, a number of improvements and finishing can be made, and these improvements and finishing should also be considered as the scope of protection of the present invention.

What is claimed is:

1. An automatic coal mining machine, comprising:

a first excavation cabin, a first coal preparation cabin, a first fluidized conversion reaction cabin, a first energy storage cabin; and a supporting cabin;

wherein a cutter dish for cutting coal mass is provided at a head of the first excavation cabin, and, raw coal cut by the cutter dish is transported to the first coal preparation cabin by the first excavation cabin;

the first coal preparation cabin is connected to the first excavation cabin by a detachable flexible component and the first coal preparation cabin is configured for separating coal blocks from gangues in raw coal and transporting the coal blocks to the first fluidized conversion reaction cabin;

the first fluidized conversion reaction cabin is connected to the first coal preparation cabin by a detachable flexible component and the first fluidized conversion reaction cabin is configured for converting energy form of the coal blocks into liquid, gas or electric energy and transporting the liquid, gas or electric energy to the first energy storage cabin;

the first energy storage cabin is connected to the first fluidized conversion reaction cabin by a detachable flexible component and the first energy storage cabin is configured for storing energy converted from the coal blocks, the supporting cabin is connected to the first excavation cabin by a detachable flexible component and the supporting cabin is configured for supporting and protecting an excavated roadway when a mine is constructed and the roadway is excavated, wherein, the supporting cabin comprises: a second supporting seat, a gas extraction mechanism, a grouting reinforcement mechanism and a roadway lining mechanism;

the second supporting seat is fixed on a bottom plate of the supporting cabin, and a space between the second supporting seat and the bottom plate enables the first conveyor belt and the objects transported on the first conveyor belt to pass through;

the gas extraction mechanism is fixed on the second supporting seat for extracting gas in coal seams on both sides of the excavated roadway;

the grouting reinforcement mechanism is fixed on the second supporting seat for injecting chemical slurry into the coal seams on both sides of the roadway to reinforce coal walls on both sides of the roadway;

the roadway lining mechanism is fixed on the second supporting seat for lining the roadway, wherein a working process of the automatic coal mining machine comprises two stages:

in a first stage: constructing a mine and excavating a roadway, the first excavation cabin, the supporting cabin and the detachably flexible components are transported to underground for connection and assembly, and the roadway is excavated after the assembly is completed, in a second stage: coal seam mining, the first excavation cabin and the supporting cabin are separated and the supporting cabin is lifted to the ground.

2. The automatic coal mining machine according to claim 1, wherein the first excavation cabin comprises: cutter dish, a pushing mechanism and a first conveyor belt;

the cutter dish is fixed at the head of the first excavation cabin;

the pushing mechanism is arranged behind the cutter dish and fixed on a bottom plate of the first excavation cabin;

the first conveyor belt is arranged on the bottom plate of the first excavation cabin.

3. The automatic coal mining machine according to claim 2, wherein the first excavation cabin further comprises: a first supporting seat and a supporting mechanism;

the first supporting seat is fixed on the bottom plate of the first excavation cabin, and a space between the first supporting seat and the bottom plate allows the first conveyor belt and objects transported on the first conveyor belt to pass through;

the supporting mechanism is fixed on the first supporting seat for reinforcing an excavated roadway.

4. The automatic coal mining machine according to claim 2, wherein the first coal preparation cabin comprises: a crusher, a movable screen jig, a second conveyor belt and a discharge pipe;

the crusher is fixed on a bottom plate of the first coal preparation cabin for crushing the raw coal;

the second conveyor belt is fixed on the bottom plate of the first coal preparation cabin and is located behind the crusher;

the movable screen jig is arranged on the bottom plate of the first coal preparation cabin and is located behind the second conveyor belt for sorting the raw coal transported on the second conveyor belt and transporting the sorted coal blocks to the first fluidized conversion reaction cabin;

the discharge pipeline is arranged at a side of the movable screen jig and the discharge pipeline is configured for discharging the sorted gangue from the first coal preparation cabin.

5. The automatic coal mining machine according to claim 1, wherein the first fluidized conversion reaction cabin comprises a fluidized conversion system;

the fluidized conversion system is arranged on a bottom plate of the first fluidized conversion reaction cabin for converting the coal block into liquid, gas or electric energy.

6. The automatic coal mining machine according to claim 1, wherein the first energy storage cabin comprises a fluidized product storage device and an energy storage device;

the fluidized product storage device is fixed on a bottom plate of the first energy storage cabin for storing converted fluidized energy products;

the energy storage device is fixed on the bottom plate of the first energy storage cabin for storing the converted electric energy.

7. The automatic coal mining machine according to claim 1, wherein the automatic coal mining machine further comprises: a second excavation cabin, a second coal preparation cabin, a second fluidized conversion reaction cabin and a second energy storage cabin;

the second energy storage cabin is connected to the first energy storage cabin by a detachable flexible component;

the second fluidized conversion reaction cabin is connected to the second energy storage cabin by a detachable flexible component;

the second coal preparation cabin is connected to the second fluidized conversion reaction cabin by a detachable flexible component;

the second excavation cabin is connected to the second coal preparation cabin by a detachable flexible component.

8. The automatic coal mining machine according to claim 1, wherein the coal mining machine further comprises: a remote console;

the remote console is configured to control working states of the first excavation cabin, the first coal preparation cabin, the first fluidized conversion reaction cabin and the first energy storage cabin based on an operation state of the automatic coal mining machine.

9. A fluidized coal mining method, which is applied to the automatic coal mining machine according to claim 1, wherein the second stage comprises:

controlling the first excavation cabin to cut the coal mass in front of the automatic coal mining machine;

controlling the first coal preparation cabin to separate the coal block from the gangue in the raw coal excavated in the first excavation cabin;

controlling the first fluidized conversion reaction cabin to convert the coal block separated in the first coal preparation cabin into liquid, gas or electric energy, wherein the converted liquid, gas or electric energy is stored in the first energy storage cabin.

* * * * *